United States Patent [19]

Shinoda et al.

[11] Patent Number: 4,495,915

[45] Date of Patent: Jan. 29, 1985

[54] FUEL INJECTION DEVICE FOR INTERNAL COMBUSTION ENGINE

[75] Inventors: Kazuo Shinoda; Nobuyuki Kobayashi, both of Toyota, Japan

[73] Assignee: Toyota Jidosha Kabushiki Kaisha, Toyota, Japan

[21] Appl. No.: 483,276

[22] Filed: Apr. 8, 1983

[30] Foreign Application Priority Data

Apr. 19, 1982 [JP] Japan ..... 57-65078

[51] Int. Cl.[3] ..... F02D 31/00

[52] U.S. Cl. ..... 123/357; 123/458; 123/459; 123/500

[58] Field of Search ..... 123/357, 358, 359, 458, 123/459, 503, 449, 500, 506, 494, 502

[56] References Cited

U.S. PATENT DOCUMENTS

| | | | |
|---|---|---|---|
| 3,661,130 | 5/1972 | Eheim | 123/357 |
| 4,348,998 | 9/1982 | Stumpp | 123/503 |
| 4,385,614 | 5/1983 | Eheim et al. | 123/506 |
| 4,395,987 | 8/1983 | Kobayashi et al. | 123/459 |

FOREIGN PATENT DOCUMENTS

| | | | |
|---|---|---|---|
| 146023 | 11/1981 | Japan | 123/357 |
| 65858 | 4/1982 | Japan | 123/449 |
| 2061403 | 5/1981 | United Kingdom | 123/357 |

*Primary Examiner*—Magdalen Y. C. Moy

*Attorney, Agent, or Firm*—Cushman, Darby & Cushman

[57] ABSTRACT

A spill port for discharging fuel is provided in a wall defining a high pressure chamber defined in a fuel injection pump, and capable of being successively communicated with respective cylinders. Opening and closing of this spill port is controlled by a solenoid valve. A fuel injection time period is calculated, pressure in a high pressure chamber is detected by a pressure sensor to obtain a fuel injection starting time, and the fuel injection time period thus calculated is added to the fuel injection starting time to obtain a fuel injection ending time. The solenoid valve is actuated to open the spill port at this fuel injection ending time, whereby the fuel in the high pressure chamber is discharged so that fuel injection is discontinued. The respective operations described above may be controlled by a microcomputer.

16 Claims, 8 Drawing Figures

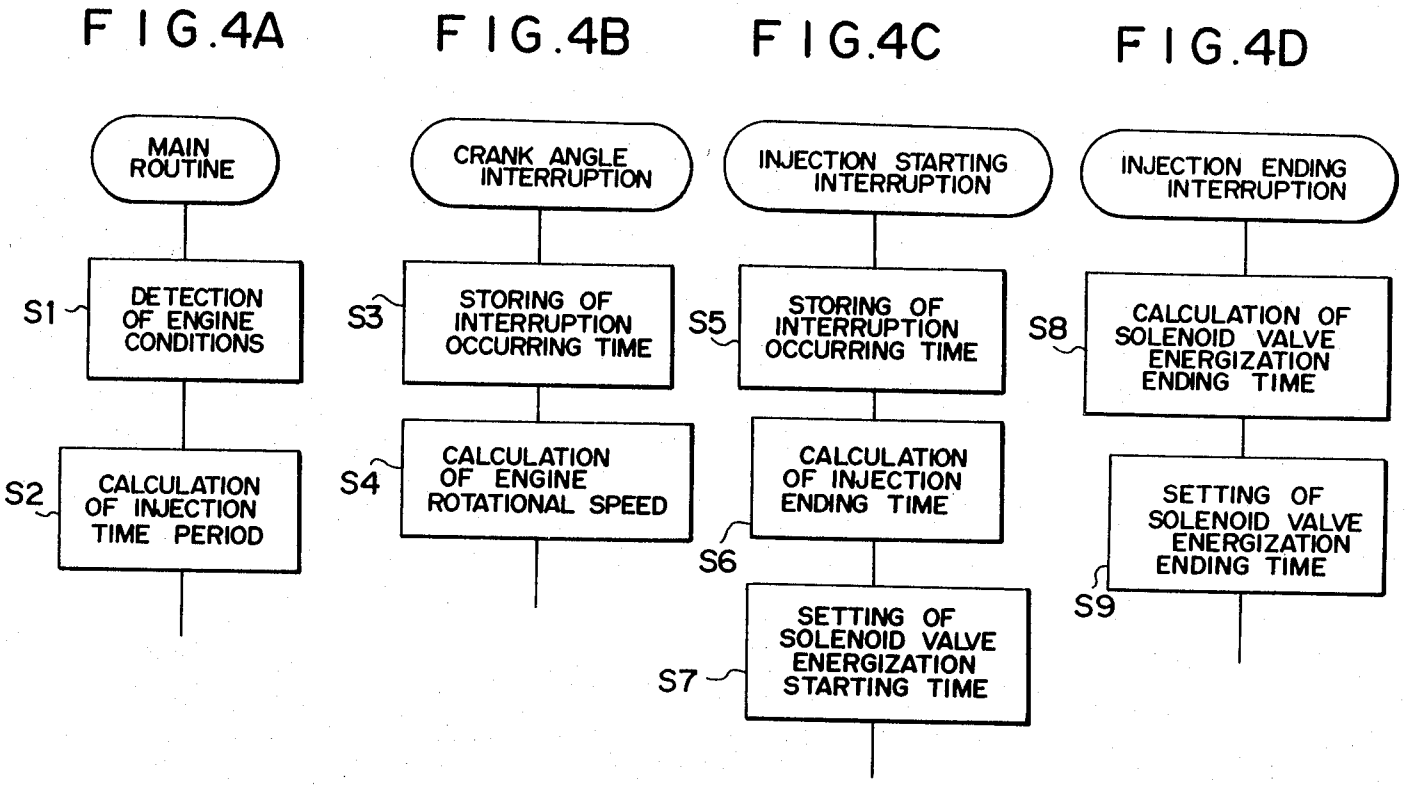
FIG.4A
MAIN ROUTINE
DETECTION OF ENGINE CONDITIONS
S1
CALCULATION OF INJECTION TIME PERIOD
S2
FIG.4B
CRANK ANGLE INTERRUPTION
STORING OF INTERRUPTION OCCURRING TIME
S3
CALCULATION OF ENGINE ROTATIONAL SPEED
S4
FIG.4C
INJECTION STARTING INTERRUPTION
STORING OF INTERRUPTION OCCURRING TIME
S5
CALCULATION OF INJECTION ENDING TIME
S6
SETTING OF SOLENOID VALVE ENERGIZATION STARTING TIME
S7
FIG.4D
INJECTION ENDING INTERRUPTION
CALCULATION OF SOLENOID VALVE ENERGIZATION ENDING TIME
S8
SETTING OF SOLENOID VALVE ENERGIZATION ENDING TIME
S9

FUEL INJECTION DEVICE FOR INTERNAL COMBUSTION ENGINE

BACKGROUND OF THE INVENTION

This invention relates to fuel injection devices for internal combustion engines, and more particularly to a fuel injection device for diesel engines which electronically controls fuel injection flow rate of a distribution-type fuel injection pump.

In a conventional fuel injection pump of the type described, fuel fed to a low pressure chamber by a feed pump is applied with high pressure by a plunger, with the fuel under high pressure supplied to respective cylinders. The fuel injection flow rate is adjusted such that an ending time is determined by a centrifugal governor, at this pump-feed ending time, the fuel is returned to the low pressure chamber through a spill port for adjustment. More specifically, the centrifugal governor comprises a governor shaft rotatable in accordance with engine rotational speed, a fly weight secured to this shaft, a tension lever connected through a spring to an accelerator lever, a spill ring for controlling opening and closing of the spill port of a plunger and a support lever connected to the spill ring (for moving the spill ring on the plunger in accordance with the engine rotational speed and a rotational angle of the accelerator lever). The centrifugal governor is adapted to determine a position of the spill ring in accordance with the movement of the fly weight, the tension lever and other levers to thereby determine the fuel pump-feed ending.

However, the velocity of movement of the plunger in the axial direction is in accordance with the engine rotational speed, and therefore, even if the position of the spill ring is made constant, the injection flow rate per stroke is varied as the velocity of movement of the plunger becomes high. Furthermore, with the conventional fuel injection flow rate control as described above, in order to change the injection flow rate in accordance with the engine rotational speed, i.e., to change the torque characteristics of the engine, it is necessary to use the very complicated mechanism as described above. Furthermore, it is difficult to desirably design the torque characteristics.

SUMMARY OF THE INVENTION

The present invention obviates the above-described disadvantages of the prior art by providing a fuel injection device for an internal combustion engine in which an injection flow rate is controlled by use of a microcomputer, whereby construction of a fuel injection pump is simplified and the torque characteristics of the internal combustion engine can be desirably designed depending on the applications.

According to the present invention, a spill port for discharging fuel is provided in a wall defining a high pressure chamber in a fuel injection pump and is capable of being successively communicated with respective cylinders, with opening and closing of this spill port controlled by a solenoid valve.

A fuel injection time period is calculated, pressure in the high pressure chamber detected by a pressure sensor and a fuel injection starting time selected. The fuel injection time period thus calculated is added to the fuel injection starting time, so that a fuel injection ending time is obtained. At this ending time, the solenoid valve is actuated to open the spill port whereby fuel in the high pressure chamber is discharged thereby discontinuing fuel injection. The respective functions described above are controlled by a microcomputer.

According to the present invention, the fuel injection flow rate can be readily controlled by use of a microcomputer without using a centrifugal governor or similar complicated mechanism. Furthermore, the change in torque is in accordance with the engine rotational speed, i.e., the torque characteristics of an internal combustion engine can be desirably designed, so that engine driving performance is improved considerably. This greatly contributes to improvements in fuel combustion rate and exhaust characteristics.

BRIEF DESCRIPTION OF THE DRAWINGS

FIGS. 4A, 4B, 4C and 4D are flow charts showing respective examples of various programs associated with the present invention.

DETAILED DESCRIPTION OF THE INVENTION

Figure 1:
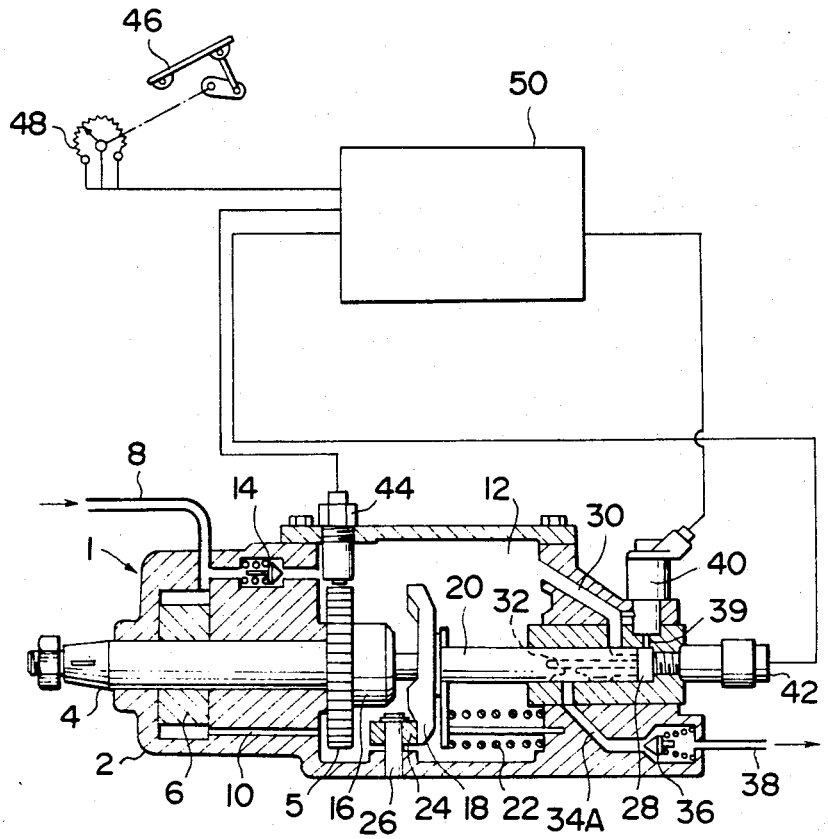
FIG. 1 is a block diagram showing an embodiment of the fuel injection device according to the present invention.

FIG. 1 shows an exemplary embodiment of the fuel injection device for an internal combustion engine according to the present invention. Designated at 1 is a fuel injection pump, with 2 a body thereof. Denoted at 4 is a pump shaft driven by an engine. Indicated at 6 is a vane-type feed pump integrally rotatable with the pump shaft 4. Fuel from a fuel tank, not shown, is fed to the pump 6 through an inlet pipe 8 and introduced to a low pressure chamber 12 through an outlet pipe 10. Designated at 14 is a relief valve to maintain pressure in the low pressure chamber 12 at a predetermined value or less, e.g., within a range of 2 to 10 kg/cm$^2$. Denoted at 18 is a cam secured to a plunger 20, with cam 18 and plunger 20 driven by pump shaft 4 through a coupling 16. The cam 18 and the plunger 20 are constantly biased to the left by a spring 22 in FIG. 1. Indicated at 24 is a roller fitted to a shaft 26 secured to the body 2, and this roller 24 is freely rotatable about shaft 26. A cam surface of the cam 18 is biased by spring 22 against the roller 24. Consequently, rotation of cam 18 causes cam 18 and the plunger 20 to slidably reciprocate to the right or left in FIG. 1.

Designated at 28 is a high pressure chamber, which may communicate with low pressure chamber 12 through fuel feed passage 30. Denoted at 32 is a fuel passage formed along the axis of the plunger 20, 34A fuel feed passages leading to respective cylinders, 36 a check valve and 38 fuel injection pipes provided for the respective cylinders. The fuel applied with high pressure by means of plunger 20 is fed to the respective cylinders through the fuel passage 32, the fuel feed passages 34A, the check valve 36 and the fuel injection pipes 38. Additionally, denoted at 21 is a discharge port provided on the outer peripheral surface of plunger 20. When the discharge port 21 is opposite one of the fuel feed passages 34A, the fuel under high pressure is fed to one of the cylinders. Indicated at 39 is a spill port formed on a side surface defining the high pressure chamber 28. Opening and closing of this spill port 39 may be controlled by a solenoid valve 40. When spill port 39 is open, the high pessure chamber 28 and the low pressure chamber 12 communicate with each other through fuel feed passage 30. In other words, fuel injections at the respective cylinders can be discontinued by opening the spill port 39.

Designated at 42 is a pressure sensor, which detects the fuel pressure in high pressure chamber 28. Denoted at 44 is an electromagnetic pickup functioning as rotational speed detecting means, which is provided in the vicinity of a gear 5 solidly secured to the pump shaft 4. Pulse signals in accordance with the rotatonal angle of the pump shaft 4 may be obtained from this pickup 44. Denoted at 46 is an accelerator pedal constituting accelerating means, and 48 is an acceleration value detecting means for obtaining a depression value of the accelerator pedal 46, i.e., an electric signal in accordance with the acceleration value, which is a potentiometer in this particular embodiment. Indicated at 50 is a control circuit for receiving signals from the potentiometer 48, the electromagnetic pickup 44 and the pressure sensor 42, and effecting a predetermined calculation (described further below) to control the timings of opening and closing of the solenoid valve. Detailed description will be given for control circuit 50.

Figure 2:
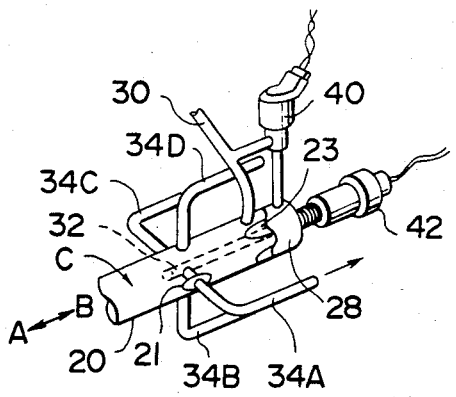
FIG. 2 is detaileed view showing certain portions of the present invention.

FIG. 2 shows in detail an example of the fuel feed passages provided around plunger 20. Notches 23 corresponding in number to the cylinders are formed at the end portion of the plunger 20. As described above, discharge port 21 is formed on the outer peripheral surface of the plunger 20. Designated at 34A, 34B, 34C and 34D are fuel feed passages provided for the respective cylinders, and, when rotation of the plunger 20 causes the discharge port 21 to meet any one of these fuel feed passages 34A through 34D, fuel is fed to one of the cylinders. When the plunger 20 moves in the direction indicated by arrow A while being rotated in a direction indicated by an arrow C and one of the notches 23 meets the fuel feed passage 30, fuel in low pressure chamber 12 is fed to high pressure chamber 28 through fuel feed passage 30. Thereafter, when the plunger 20 moves in a direction indicated by an arrow B, fuel in high pressure chamber 28 is compressed to be placed under high pressure. At this time, fuel under high pressure is fed to any one of the fuel feed passages 34A through 34D meeting the discharge port 21. For the series of actions described above, spill port 39 is closed by solenoid valve 40. When the fuel under high pressure is fed to the respective cylinders, if the spill port 39 is opened the high pressure chamber 28 is communicated with low pressure chamber 12, whereby fuel under high pressure in high pressure chamber 28 flows out into low pressure chamber 12. Thus, fuel injections to the respective cylinders are brought to an end.

Figure 3:
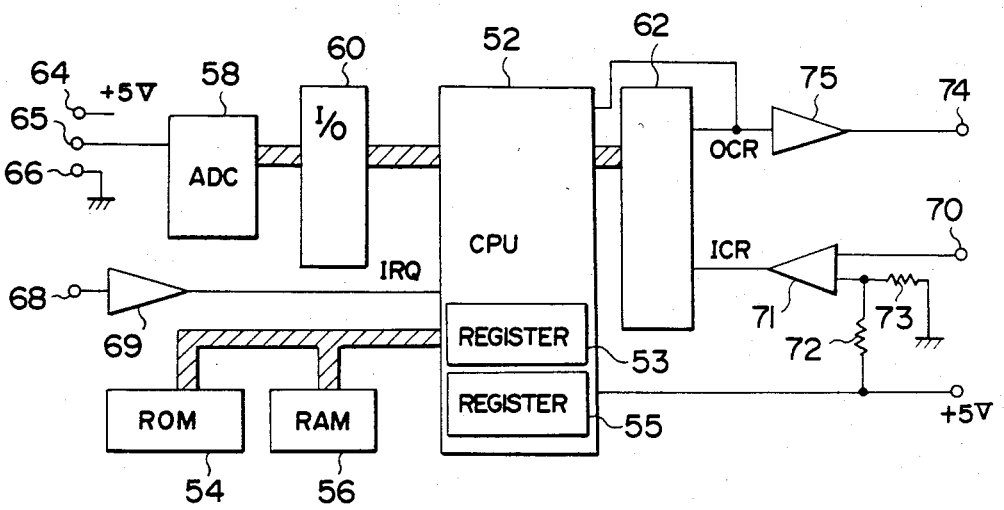
FIG. 3 is a detailed block diagram showing a control circuit of the present invention.

FIG. 3 shows in detail the arrangement of control circuit 50. Designated at 52 is a Central Processing Unit (hereinafter referred to as "CPU") which is adapted to control various components as described hereunder. Denoted at 54 is a Read Only Memory (hereinafter referred to as "ROM") in which various programs are stored, 56 a Random Access Memory (hereinafter referred to as "RAM") in which various data is temporarily stored, 58 an Analogue to Digital converter (hereinafter referred to as "A/D converter") which converts analogue data into digital data, 60 an Input/Output port (hereinafter referred to as "I/O port") and 62 a programmable timer constituting time measuring means. Indicated at 64, 65 and 66 are input terminals, to which is inputted a detection signal of an acceleration value from the potentiometer 48, and this analogue signal is converted into a digital signal by A/D converter 58. Designated at 68 is an input terminal to which is inputted a signal from the electromagnetic pickup 44, and this detection signal of the engine rotation is fed to CPU 52 through a waveshape amplifier 69. This signal from amplifier 69 is used for an interruption signal IRQ, described hereunder. Denoted at 70 is an input terminal, to which is inputted a signal from the pressure sensor 42, and this detection signal if fed to the programmable timer 62 through a comparator 71. This signal ICR fed to the programmable timer 62 is used for an interruption signal, described hereunder.

Indicated at 72 and 73 are resistors by which the comparison voltage of comparator 71 is set. When a signal fed to input terminal 70 from pressure sensor 42 exceeds a reference voltage, the signal ICR of a predetermined voltage level from comparator 71 is fed to the programmable timer 62. Designated at 74 is an output terminal, which is connected to solenoid valve 40, shown in FIG. 1. An output signal OCR from the programmable timer 62 is amplified by an amplifier 75, so that satisfactory power for driving solenoid valve 40 can be obtained. Thereafter, a power of predetermined value is fed from output terminal 74 to solenoid valve 40.

Figure 5:
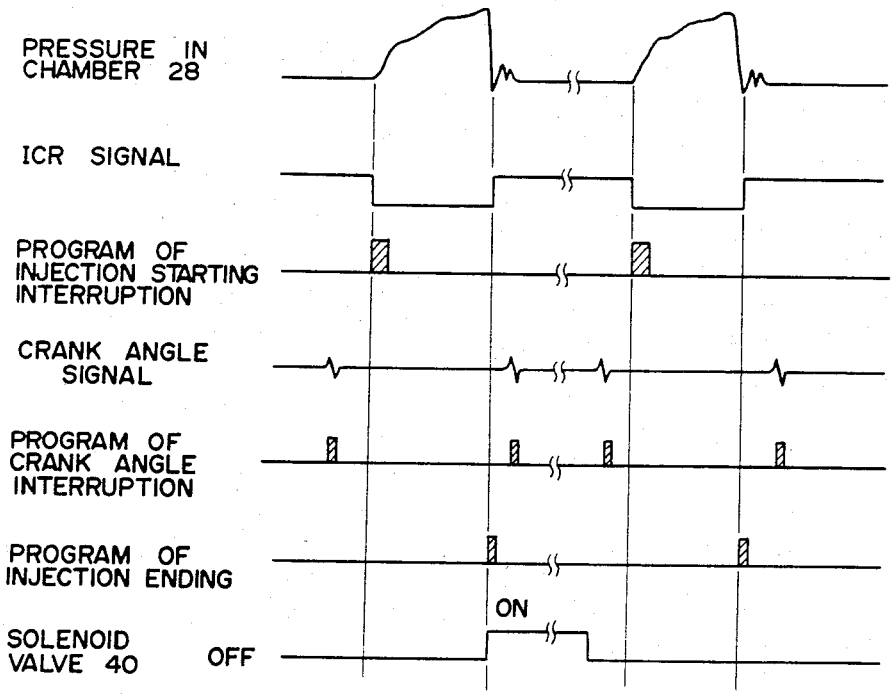
FIG. 5 is a time chart showing various signals and starting times of the various programs of FIG. 4.

FIGS. 4A, 4B, 4C and 4D are respective examples of various programs stored in ROM 54 shown in FIG. 3. FIG. 5 shows an example of a time chart indicating various signals and starting times of the various programs. Procedural steps indicated in FIGS. 4A through 4D with reference to FIG. 5 will now be described.

FIG. 4A shows an example of a main routine, in which, in Step S1, the condition of the engine is detected, and in Step S2, a fuel injection time period is calculated. The calculation of the fuel injection time period is carried out on the basis of engine rotational speed, depression value of the accelerator pedal 46, and the like. FIG. 4B shows an example of a crank angle interruption program, in which, in Step S3, the time of starting this program is stored, and, in Step S4, engine rotational speed is calculated. In this example, according to this crank angle interruption program, interruptions are made every time the crankshaft is angularly displaced through 90 degrees. In this example, a signal indicating that the crankshaft has been angularly displaced through 90 degrees obtained from magnetic pickup 44. FIG. 4C shows an example of a fuel injection start interruption program. According to this program, process is started when pressure has risen in the high pressure chamber 28. In step S5, the time of occurrence of the interruption is stored, and in Step S6, the fuel injection ending time is calculated on the basis of the result of Step S2 shown in FIG. 4A. In Step S7, a time at which the solenoid valve 40 is energized on the basis of the ending time obtained in Step S6 is set, for example, in a first time storing means in the CPU 52, i.e., in register 53 in this example.

FIG. 4D shows an example of a fuel injection end interruption program, where an interruption is effected when the pressure in high pressure chamber 28 has lowered to predetermined value. In Step S8, the time of ending energization of solenoid valve 40 is calculated on the basis of the succeeeding fuel injection starting time. Then, in Step S9, a closing time of the solenoid valve 40 for ending energization of the solenoid valve 40 is set, for example, in a second time storing means in the CPU 52, i.e., in register 55 in this example. More specifically, the solenoid valve 40 is actuated only when the solenoid valve energization starting time stored by register 53 of CPU 52 in Step S7 shown in FIG. 4C coincides with the time of programmable timer 62. At this time, spill port 39 is opened, and fuel under high pressure in the high pressure chamber 28 flows out into the low pressure chamber 12 through the fuel feed passage 30. Consequently, fuel injections to the respective cylinders are discontinued. Furthermore, in Step S9 shown in FIG. 4D, when the solenoid valve energization ending time set in register 55 of CPU 52 coincides with the content of the programmable timer 62, an output from programmable time 62 deenergizes solenoid valve 40 to close spill port 39.

As described above, in this embodiment of the present invention, an engine rotational speed is indicated on the basis of input signals from electromagnetic pickup 44, a depression value of the accelerator pedal 46 is obtained from a signal from the potentiometer 48 interlocked with the accelerator pedal 46, and a fuel injection time period is obtained on the basis of the two data. The fuel injection starting time is detected from a signal from pressure sensor 42. Then, the fuel injection time period is added to the fuel injection starting time to obtain the fuel injection ending time. Further, spill port 39 formed in the wall defining the high pressure chamber 28 is connected to low pressure chamber 12 through the solenoid valve 40, and the solenoid valve 40 is actuated at the aforesaid fuel injection ending time to open spill port 39 so that high pressure chamber 28 can communicate with low pressure chamber 12. Thus, the fuel under high pressure is fed to low pressure chamber 12, whereby fuel injection to the respective cylinders is discontinued. Consequently, the fuel injection flow rate can be readily regulated by controlling the opening and closing of solenoid valve 40.

What is claimed is:

1. A fuel injection device for an internal combustion engine, comprising:

a fuel injection pump including;

a high pressure chamber wherein fuel is applied with high pressure, plunger means rotatably and slidably reciprocable in synchronism with rotation of the engine for introducing said fuel into said high pressure chamber, applying high pressure to said fuel in said high pressure chamber by slidable movement toward said high pressure chamber and feeding said fuel under high pressure to any one of cylinders in said engine, said slidable movement of said plunger beginning at a constant angular position of a crank shaft without regard to rotational speed of said engine, a spill port formed in a wall defining said high pressure chamber for discharging said fuel in said high pressure chamber;

a solenoid valve for opening or closing said spill port;

a pressure sensor mounted facing said high pressure chamber for detecting pressure in said high pressure chamber; and a control circuit for controlling said solenoid valve to close said spill port at a closing time to thereby inject fuel and open said port at a fuel injection ending time to stop fuel injection, said control circuit including:

first calculation means for calculating a fuel injection time period in accordance with operating conditions of the engine, detection means for detecting a fuel injection starting time when pressure in said high pressure chamber as detected by said pressure sensor exceeds a predetermined pressure, second calculation means for calculating said fuel injection ending time based on said fuel injection time period and said fuel injection starting time, and third calculation means for calculating said closing time so that a next fuel injection takes place at said closing time if slidable movement of said plunger begins prior to said closing time.

2. A fuel injection device for a internal combustion engine as set forth in claim 1, wherein:

said fuel injection pump further includes a fuel feed pump, a low pressure chamber where said fuel is fed from said fuel feed pump and fuel pressure is maintained in accordance with engine rotational speed, and including a fuel feed passage communicating said high pressure chamber with said low pressure chamber; and said solenoid valve is interposed between said spill port and said fuel feed passage.

3. A fuel injection device for an internal combustion engine as set forth in claim 1, said device further comprising:

rotational speed detecting means for detecting engine rotational speed, and acceleration value detecting means for detecting an acceleration value applied to the engine, wherein said first calculation means calculates said fuel injection time period based on said engine rotational speed obtained in response to a detection signal emitted from said rotational speed detecting means, and based on said acceleration valve obtained in response to a detection signal emitted from said acceleration value detecting means.

4. A fuel injection device for an internal combustion engine as set forth in claim 1, said device further comprising:

rotational speed detecting means for detecting an engine rotational speed, and acceleration value detecting means for detecting an acceleration value applied to the engine, wherein:

said fuel injection pump further includes a fuel feed pump, a low pressure chamber where said fuel is fed from said fuel feed pump and fuel pressure is maintained in accordance with engine rotational speed, and including a fuel feed passage communicating said high pressure chamber with said low pressure chamber;

said solenoid valve is interposed between said spill port and said fuel feed passage;

said first calculation means calculates said fuel injection time period based on said engine rotational speed obtained in response to a detection signal emitted from said rotational speed detecting means, and based on said acceleration value obtained in response to a detection signal emitted from said acceleration value detecting means; and said solenoid valve is actuated at said fuel injection ending time to open said spill port and is kept in its actuated state until said closing time, whereby the fuel under high pressure in said high pressure chamber is released to said low pressure chamber at said fuel injection ending time and said plunger begins compressing fuel in said high pressure chamber at said closing time.

5. A fuel injection device for an internal combustion engine as set forth in claim 3, wherein:

said rotational speed detecting means obtains a detection signal in accordance with rotation of a pump shaft driving said plunger in order to detect said engine rotational speed.

6. A fuel injection device for an internal combustion engine as set forth in claim 3, wherein:

said rotational speed detecting means comprises an electromagnetic pickup.

7. A fuel injection device for an internal combustion engine as set forth in claim 3, wherein:

said rotational speed detecting means comprising an electromagnetic pickup wherein a detection signal in accordance with rotation of a pump shaft driving said plunger is obtained, and said detection signal is emitted each time a crankshaft of said engine rotates through a predetermined angle.

8. A fuel injection device for an internal combustion engine as set forth in claim 3, wherein:

said acceleration value detecting means includes a potentiometer for obtaining an electric signal in accordance with a depression value of an accelerator pedal.

9. A fuel injection device for an internal combustion engine as set forth in claim 1, wherein:

said control circuit further includes first time storing means for storing said fuel injection ending time, second time storing means for storing said closing time and time measuring means, and said control circuit actuates said solenoid valve to open it when the contents of said first time storing means and said time measuring means coincide with each other, and said control circuit actuates said solenoid to close said valve when the contents of said second time storing means and said time measuring means coincide with each other.

10. A fuel injection device for an internal combustion engine as set forth in claim 2, wherein:

said control circuit further includes first time storing means for strong said fuel injection ending time, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

11. A fuel injection device for an internal combustion engine as set forth in claim 3, wherein:

said control circuit further includes first time storing means for storing said fuel injection ending time therein, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

12. A fuel injection device for an internal combustion engine as set forth in claim 4, wherein:

said control circuit further first time storing means for storing said fuel injection ending time, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

13. A fuel injection device for an internal combustion engine as set forth in claim 5, wherein:

said control circuit further includes first time storing means for storing said fuel injection ending time, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

14. A fuel injection device for an internal combustion engine as set forth in claim 6, wherein:

said control circuit further includes first time storing means for storing said fuel injection ending time, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

15. A fuel injection device for an internal combustion engine as set forth in claim 7, wherein:

said control circuit further includes first time storing means for storing said fuel injection ending time, second time storing means for storing said closing time and time measuring means, and said control circuit actuates said solenoid valve to open it when the contents of said first time storing means and said time meausring means coincide with each other, and said control circuit actuates said solenoid valve to close it when the contents of said second time storing means and said time measuring means coincide with each other.

16. A fuel injection device for an internal combustion engine as set forth in claim 8, wherein:

said control circuit further includes first time storing means for storing said fuel injection ending time, second time storing means for storing said closing time and time measuring means, and said control circuit actuates said solenoid valve to open it when the contents of said first time storing means and said time measuring means coincide with each other, and said control circuit actuates said solenoid valve to close it when the contents of said second time storing means and said time measuring means coincide with each other.

* * * * *